US010166585B2

(12) United States Patent
Claasen et al.

(10) Patent No.: US 10,166,585 B2
(45) Date of Patent: Jan. 1, 2019

(54) EXTRUDER AND TUBE EXTRUDER OR METAL EXTRUSION PRESS

(71) Applicant: SMS MEER GMBH, Mönchengladbach (DE)

(72) Inventors: Karl Claasen, Moers (DE); Uwe Muschalik, Duisburg (DE)

(73) Assignee: SMS MEER GMBH, Moenchengladbach (DE)

( * ) Notice: Subject to any disclaimer, the term of this patent is extended or adjusted under 35 U.S.C. 154(b) by 420 days.

(21) Appl. No.: 14/128,065

(22) PCT Filed: Oct. 31, 2012

(86) PCT No.: PCT/EP2012/004554
§ 371 (c)(1),
(2) Date: Apr. 20, 2014

(87) PCT Pub. No.: WO2013/064251
PCT Pub. Date: May 10, 2013

(65) Prior Publication Data

US 2015/0290690 A1 Oct. 15, 2015

(30) Foreign Application Priority Data

Oct. 31, 2011 (DE) ..... 10 2011 117 275

(51) Int. Cl.
*B21C 23/21* (2006.01)

(52) U.S. Cl.
CPC ..... *B21C 23/217* (2013.01); *B21C 23/211* (2013.01)

(58) Field of Classification Search
CPC ..... B21C 23/21–23/218
See application file for complete search history.

(56) References Cited

U.S. PATENT DOCUMENTS 3,357,227 A 12/1967 Walker et al.
5,660,783 A * 8/1997 Urbanek ..... B29C 45/6771 264/328.1
7,216,522 B2 * 5/2007 Gala ..... B21C 23/212 72/253.1

(Continued)

FOREIGN PATENT DOCUMENTS

EP 0822017 A 2/1998
JP 3114611 B2 12/2000

*Primary Examiner* — Teresa M Ekiert
*Assistant Examiner* — Gregory Swiatocha
(74) *Attorney, Agent, or Firm* — Andrew Wilford

(57) ABSTRACT

A tube or metal extrusion press has a stationary press frame formed by a main housing, a counter housing, a billet support carrying a billet holder, and a ram cross-member movable in the press frame between the housings. A piston-cylinder unit has a cylinder on the main housing, a piston in the cylinder, and a ram stem extending between a front end of the piston and the ram cross-member. An equalizing reservoir supplies hydraulic fluid to the piston, and a transfer passage extends between the reservoir and the cylinder rearward of the piston. A fill valve has a displacement sleeve on a rod and carries a ring piston and a fill valve body movable centrally of the cylinder in the transfer passage between an open position in which the passage has a large annular flow cross-section and a closed position in which the valve body blocks the passage.

3 Claims, 3 Drawing Sheets

(56) References Cited

U.S. PATENT DOCUMENTS

| | | | | |
|---|---|---|---|---|
| 7,421,874 | B2 * | 9/2008 | Claasen | B30B 1/323<br>72/253.1 |
| 2012/0244239 | A1 * | 9/2012 | Yamamoto | B21C 23/211<br>425/258 |

* cited by examiner

EXTRUDER AND TUBE EXTRUDER OR METAL EXTRUSION PRESS

CROSS REFERENCE TO RELATED APPLICATIONS

This application is the US-national stage of PCT application PCT/EP2012/004554 filed 31 Oct. 2013 and claiming the priority of German patent application 102011117275.4 itself filed 31 Oct. 2011.

FIELD OF THE INVENTION

The invention relates to a tube or metal extrusion press that has a press frame formed by a cylinder housing and counter housing attached thereto and in which a movable billet support carrying a billet holder and a movable ram cross-member are provided, a piston-cylinder unit provided in the cylinder housing holding within its cylinder a piston that at its front end is supported by the ram cross-member and is provided with an extrusion ram stem, the extrusion press having an equalizing reservoir associated with the cylinder and connected to a tank line to supply hydraulic fluid to the piston by means of a piston disk provided on a rod attached to a rear end of the piston, the rod extending in the equalizing reservoir being connected to a hydraulic supply means provided rearward of the piston disk in the extrusion direction.

BACKGROUND OF THE INVENTION

An extrusion press of this type where the counter housing that carries the tool, usually the pressure plate, female die holder and die, and connected to the cylinder beam by tie rods and/or tension beams as well as compression beams is known from DE 102 27 488 [U.S. Pat. No. 7,216,522]. Furthermore, EP 1 526 930 [U.S. Pat. No. 7,421,874] also discloses a metal extrusion press with a compensation tank that is mounted on the piston-cylinder unit for supplying hydraulic fluid under pressure to the press piston and/or piston. The rod supporting the piston disk is provided with an advance and retraction cylinder, and with a hydraulic connection unit attached to the outside of the end wall or rear wall of the equalizing reservoir. The piston disk that is provided on the rod end furthest removed from the piston-cylinder unit housing slides within the equalizing reservoir, the fill space that is closed at the end by the piston disk being connected through connection lines to the cylinder chamber of the piston-cylinder unit that is located in back of the piston, into which space a hydraulic fluid line discharges.

To achieve a high level of efficiency of the presses, nonproductive times must be minimized; in particular, the displacement and lateral cylinders that are provided for the billet support, inside which are provided the billet holder and/or recipient, and the punch crosshead and/or mobile spar must be able to handle idling and retraction at optimum speeds. To this end, large flow volumes must be moved between the cylinders and the oil tank at high flow rates, resulting in turbulent flow and, consequently, foaming due to air trapped in the oil. These disadvantageous operating conditions can only be counteracted by implementing measures of great complexity.

In EP 1 526 930, actuatable check valves are associated with the rod provided in the form of an advance and retraction cylinder in the connection lines that are located in the cylinder base and lead from the fill space of the equalizing reservoir to the cylinder chamber following the piston.

What this achieves is that this piston is bathed in oil supplied from the fill space of the equalizing reservoir to effect the piston's advancement to its working position when the check valves are open, there being four of these valves that are formed as two-way integrated valves, also called logic or cartridge valves. The connection lines are closed by the check valves once the piston has reached is working position, the piston being of the same diameter as the equalizing reservoir, and the piston starts the extrusion process, with the result that the slide forces the volume of oil remaining in the equalizing reservoir only into the tank, while the subsequent delivery of hydraulic fluid is now effected only through the hydraulic fluid line, which oil thus does not have to be resupplied, thereby allowing the tank to be at a remote location. This then no longer necessitates having oil lines of large cross-section, such as would be the case without the equalizing reservoir. When the press stroke ends and the return motion of the piston to its starting position is initiated by the associated reversal of the hydraulic unit, the oil flows back into the equalizing reservoir, i.e., the oil is forced back and forth under pressure as the tube/extrusion press operates.

In a frameless metal extrusion press, as disclosed in EP 0 822 017, the handling of large flow volumes is achieved in that two or more press pistons are envisioned that are provided with piston rods of the same diameter traversing their cylinders at both ends, and that the piston rods are sealed on both sides relative to the cylinders, such that cylinder-type partial chambers with areas of equal effectiveness are present on both faces that are connected to each other by a bypass line via a switchable locking valve that can be closed during the working stroke. Special piston drive cylinders are provided for a fast return stroke and high-speed advance on this press. The bypass line that connects the cylinder chambers on both sides of the press piston allows for a quick transfer of the oil from side of the cylinder to the other and with minimal flow resistance, where, however, the bypass lines and the switchable locking valves therein must be quite large.

OBJECT OF THE INVENTION

The object of the invention is therefore to provide a tube or metal extrusion press of the type referenced above without the above-described disadvantages; in particular, the object is to enable the cost/complexity of hydraulics to be reduced and the idle times to be shortened, while providing a design that is both simper and compact.

SUMMARY OF THE INVENTION

This object is achieved according to the invention by an approach wherein the rod is provided with a fill valve that is integrated in the transfer passage from the equalizing reservoir to the piston-cylinder unit, is matched to the interior diameter of the cylinder there, and forms opens a large annular cross-section when open. The fill valve that is integrated centrally in the cylinder of the piston-cylinder unit enables a large annular flow cross-section to be provided through which the oil can flow with low resistance from the equalizing reservoir into the pressing chamber behind the piston, then back into the equalizing reservoir when the piston motion is reversed. The displacement, or advance and retraction, of the piston moved in the piston-cylinder unit, preferably, with hydrostatic suspension, can thus be effected very rapidly, thereby allowing idle times to be shortened for the in-feed of the piston and billet support. The volume of hydraulic fluid required for the in-feed to extrude the loaded billet into an extrusion product can preferably be supplied from a tank or other hydraulic fluid supply to the pressing chamber of the cylinder in back of the piston. Interposing a tank requires a significantly smaller oscillating volume.

A preferred embodiment of the invention provides an approach whereby the fill valve is formed by a fill-valve body that is provided through a collar-like displacement sleeve on the rod, and by a ring cylinder surrounding the displacement sleeve in back of the valve body in the extrusion direction, the ring piston of this ring cylinder moving the displacement sleeve, and thus the valve body, either into the closed position or into the open position as a function of the piston side being supplied with hydraulic fluid. When the ring piston is forced in the extrusion direction, the pressure chambers of the ring piston provided—as viewed in the extrusion direction—in front of and in back of the ring piston with appropriate hydraulic lines, the ring piston pushes the fill valve body by the collar from its closed position against a valve-seat seal into the open position in which the fill-valve body engages or drops into a recess of the piston.

An end-position attenuation means provided in an embodiment of the invention in the hydraulic line to the ring piston of the ring cylinder here cushions the approach toward the end position of the fill valve body.

In an advantageous proposal of the invention, the fill valve is integrated in the cylinder of a press frame in which the ram cross-member and the billet support are driven by electric motors, preferably, servomotors. The extremely large, free flow cross-section of the fill valve makes this valve especially well-suited for operating the tube extrusion press and extrusion press, first of all, with alternatingly actuated servomotor-type drives to move ram cross-member and billet support, and secondly, to apply the required high upsetting and pressing force and, in particular, the pressing force for extruding the billet into an extruded product. The extrusion operation thus now requires significantly reduced hydraulics. Possible approaches here also include achieving savings in energy by employing regenerative units from the braking energy of the electro-hydraulic drive units.

BRIEF DESCRIPTION OF THE DRAWING

Additional features and details of the invention are revealed in the claims and in the following description of embodiments shown in drawing. Therein:

SPECIFIC DESCRIPTION OF THE INVENTION

Figure 1:
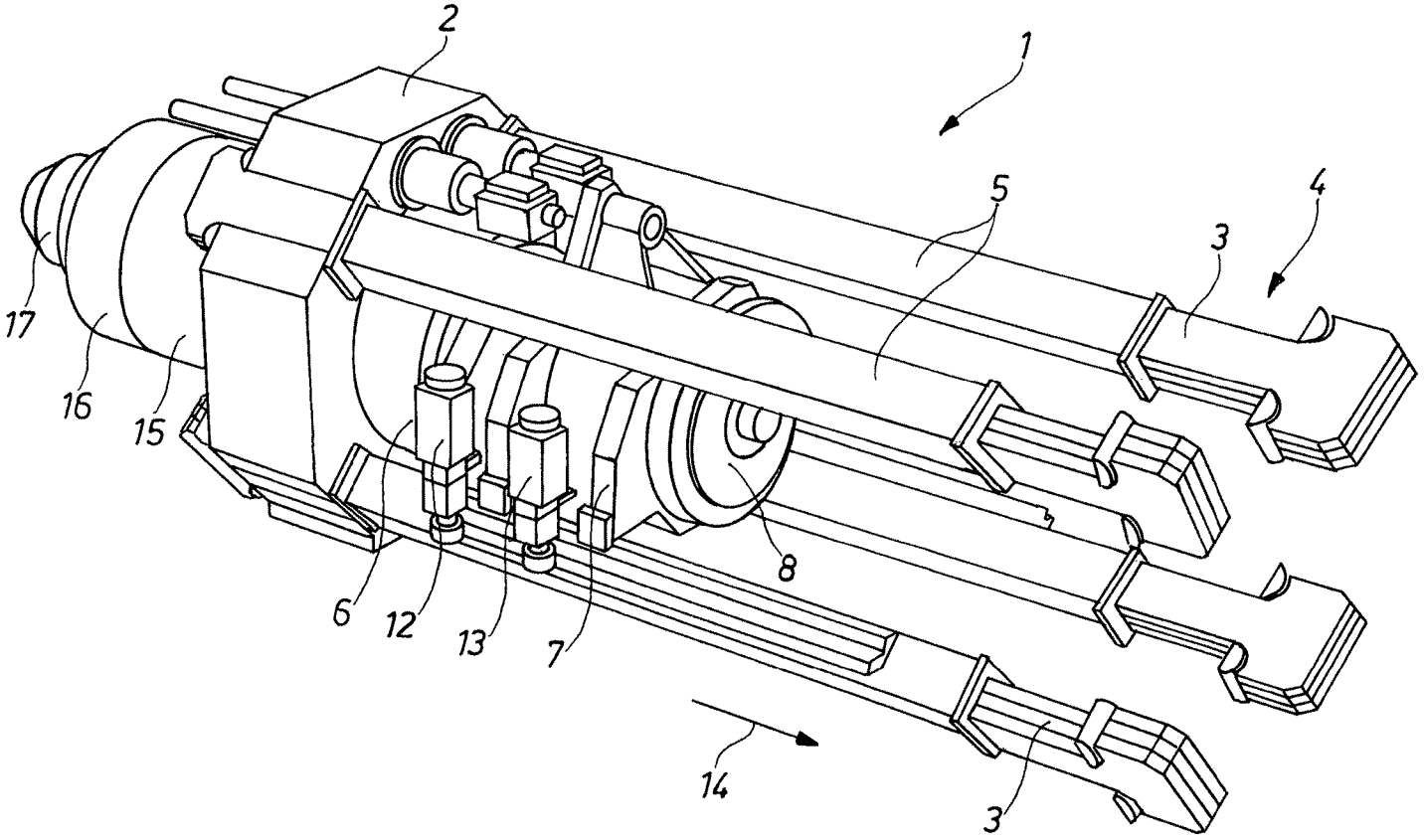
FIG. 1 is a perspective view showing a detail of a tube or metal extrusion press showing its press frame including a ram cross-member and billet support.

FIG. 1 shows essentially the basic frame of a tube or metal extrusion press 1. This frame is formed by a cylinder housing 2 and a counter housing that is spaced therefrom, fixed relative thereto by lamellar tie rods 3, and not shown here but indicated at the end of lamellar tie rods 3 only by reference numeral 4. Compression beams 5 furthermore contribute to creating the positive connection between these components and surround the lamellar tie rods 3 between the cylinder housing 2 and the counter housing 4. These compression beams 5 also act as guides for a ram cross-member 6 that is movable within the base frame, and of a movable billet support 7. The ram cross-member 6 that supports the front end of a piston 11 guided inside a cylinder 9 in the counter housing 4 in a bushing 10 (see FIG. 2) and the billet support 7 that has a billet holder 8 are here moved in an extrusion direction 14 by respective electric motors 12 or 13, in particular servomotors. One electric motor 12 or 13 of this type is provided on each longitudinal side of the billet support 7 and the ram cross-member 6. Pinions of the electric motors 12 or 13 engage gear racks in order to transmit force or create movement.

An equalizing reservoir 15 is bolted onto the rear end of the cylinder 9 of the cylinder housing 2, and a cylinder or hydraulic connector 17 is bolted onto the end or rear wall 16 of the reservoir that is constructed for example as disclosed in EP 1,526,930. Optionally, the press 1 can be fitted with known hydraulically actuated and laterally mounted cylinders and container displacement cylinders instead of the electric motors 12 and 13, in order to effect the travel and feed motions of the ram cross-member 6 and the billet support 7. The piston 11 has a stem 18 responsible for the upsetting and extruding a billet in the billet holder 8.

Figure 2:
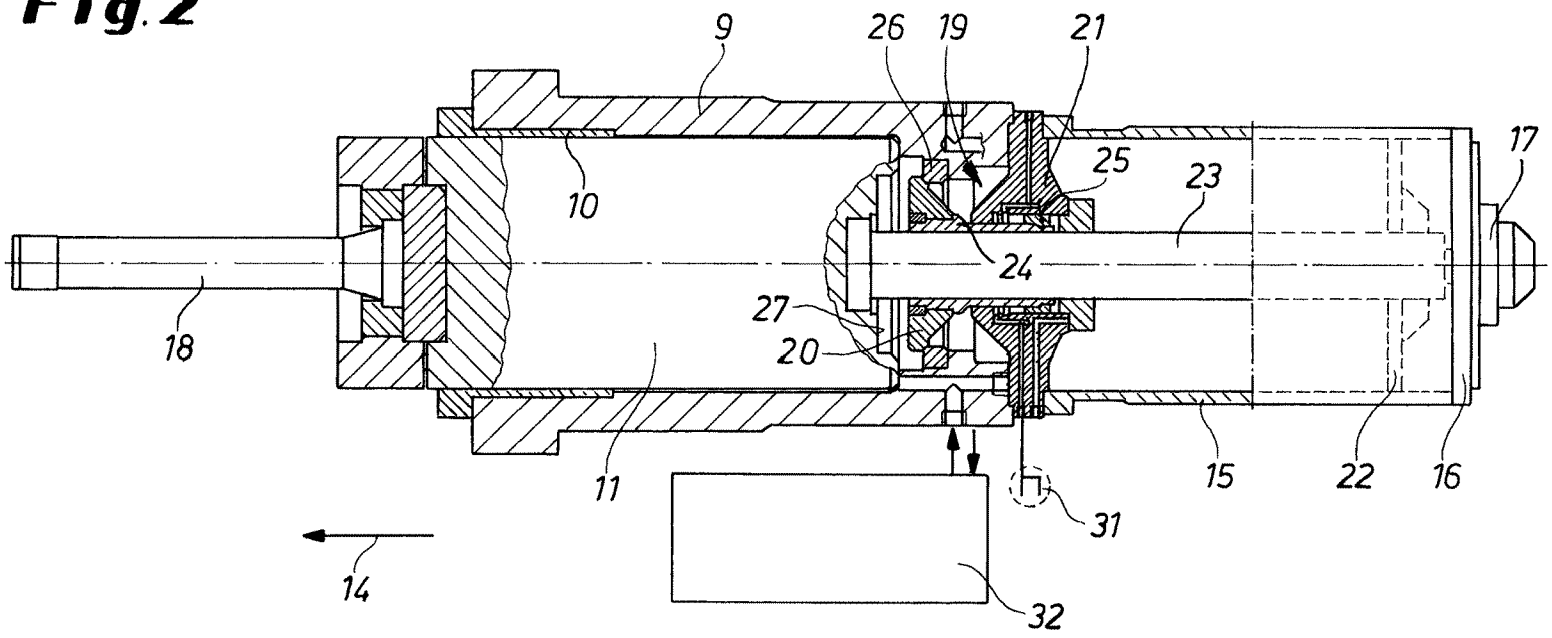
FIG. 2 is a partial cutaway view of the rear end of a tube/extrusion press, without the ram cross-member and billet support.
Figure 3:
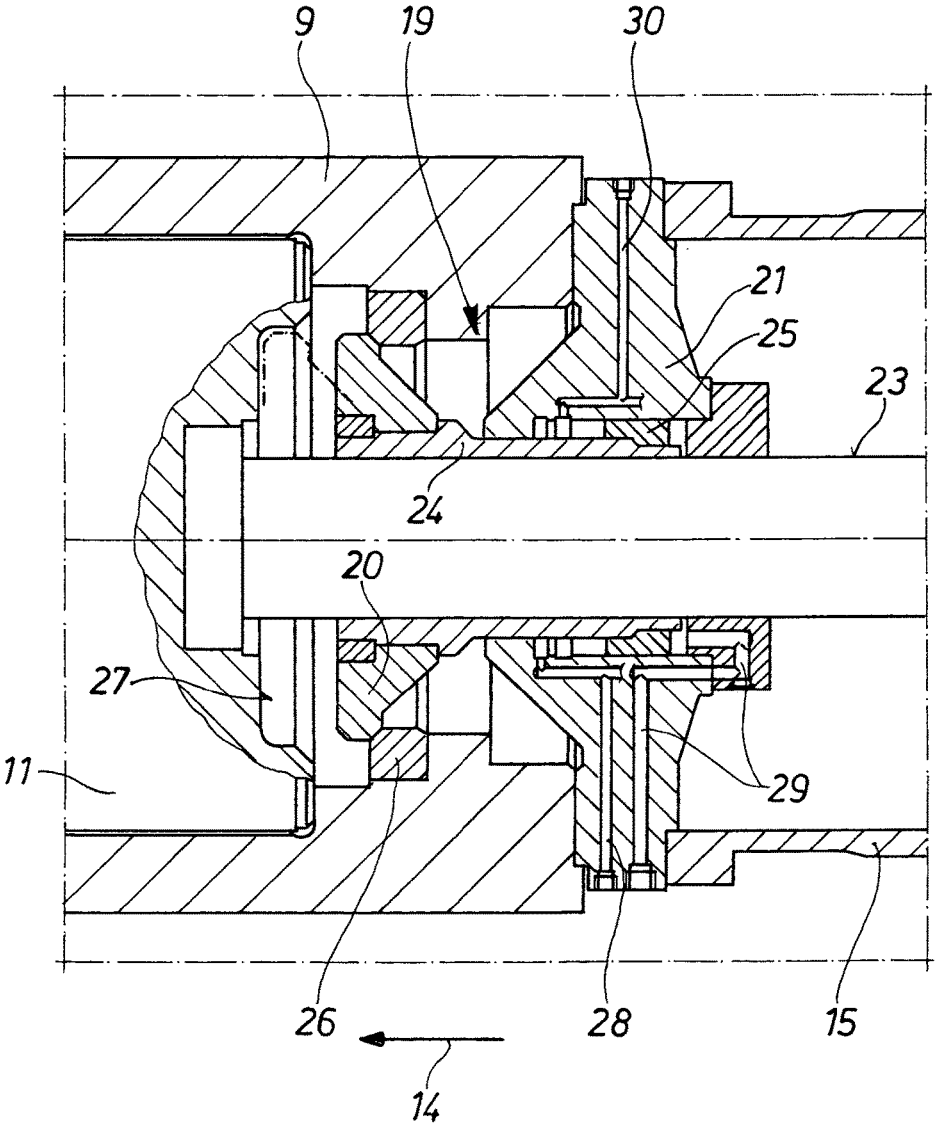
FIG. 3 is a sectional detail from FIG. 2 showing the fill valve integrated into the cylinder of the piston-cylinder unit in the transfer passage to the equalizing reservoir.

FIG. 2 illustrates that a central fill valve 19 is integrated in the cylinder 9 of the piston-cylinder unit, the fill valve being formed by an extended valve body 20 and a ring cylinder 21 that actuates the fill valve. FIG. 3 is an enlarged detail showing that the fill valve 19 is provided on a rod 23 that is attached to the rear end of the piston 11, extends into the equalizing reservoir 15, and there supports a piston disk 22, a collar-like displacement sleeve 24 being provided that is surrounded by the ring cylinder 21. When the rear end of a ring piston 25 in the ring cylinder 21 is acted upon by hydraulic fluid, a displacement sleeve 24 and the fill-valve body 20 are moved from a closed position shown by solid lines and resting on a valve-seat seal 26 into an open position indicated by broken lines in which the valve body 20 fits into a complementary recess 27 of the piston 11.

When the fill valve 19 is in the open position, a large free flow cross-section or annular cross-section is provided through which the hydraulic fluid can flow with little resistance from the equalizing reservoir 15 into the pressure chamber of the cylinder 9 in back of the piston 11, as well as flow in the reverse direction. To move the fill valve 20 into the closed position, pressurization of the ring cylinder 21 is reversed so that hydraulic fluid is pressurized in front of the ring piston 25 to retract the displacement sleeve 24 together with the fill valve body 20. The hydraulic fluid lines connected to an unillustrated supply for delivering hydraulic fluid in front of and in back of the ring piston 25 are indicated at 28, 29, and 30 in FIG. 3, an end-position buffer 31 being associated with the hydraulic fluid line 28 as shown in FIG. 2.

In response to the in-feed motions, i.e. travel of the ram cross-member 6 and/or the billet support 7 in the extrusion direction 14, hydraulic fluid is forced by simultaneously moving the piston disk 22 by the opened fill valve body 20 and through the thereby exposed large flow cross-section from the equalizing reservoir 15 into the pressure chamber in back of the piston 11 until the piston 11 has moved into an intermediate position for the extrusion process. For the actual subsequent extrusion, the fill valve 19 is closed and the extrusion force is applied by feeding hydraulic fluid from a tank 32 indicated by the upward-pointing arrow in FIG. 2 into the pressure chamber in back of the piston 11. Since the fill valve 19 is closed, the piston 11 moves it in the extrusion direction 14 to pull the piston disk 22 by the rod 23 out of the equalizing reservoir 15 to force additional fluid into the tank 32 as indicated by the downward-pointing arrow in FIG. 2.

In order to prepare for a new loading and extrusion operation, the hydraulic fluid flows in response to rearward motion of the piston 11 through the fill valve 19, now re-opened by the ring cylinder 21, back into the equalizing reservoir 15, i.e. the hydraulic fluid is forced back and forth with little resistance when the tube/extrusion press 1 is operating. It is obvious that the drives (electric motors or displacement cylinders) of the ram cross-member 6 and of the billet support 7 are actuated accordingly.

The invention claimed is:

1. A tube or metal extrusion press comprising:

a stationary press frame formed by a main housing and a counter housing attached thereto and spaced therefrom;

a billet support carrying a billet holder and a ram cross-member movable in the press frame between the main housing and the counter housing;

a piston-cylinder unit having a cylinder on the main housing, a piston in the cylinder, and a ram stem extending between a front end of the piston and the ram cross-member;

an equalizing reservoir associated with the cylinder and supplying hydraulic fluid to the piston;

a transfer passage extending between the reservoir and the cylinder rearward of the piston;

a piston disk in the reservoir;

a rod extending between a rear end of the piston and the disk and extending in the equalizing reservoir;

a fill valve having a displacement sleeve carried on the rod and carrying a ring piston and a fill valve body integrated centrally in the cylinder and movable in the transfer passage between an open position in which the passage has a large annular flow cross-section and a closed position in which the valve body blocks the passage; and feed lines effective on opposite faces of the ring piston for pressurizing the ring piston alternately and thereby shifting the displacement sleeve, ring piston, and fill valve body between the open position and the closed position, whereby in the open position the cylinder can fill rapidly from the reservoir or empty rapidly into the reservoir and in the closed position the cylinder can be pressurized for extrusion of a billet in the holder.

2. The press according to claim 1, further comprising:

electric motors for shifting the ram cross-member and the billet support in the press frame for rapid filling and emptying of the cylinder in the open position of the valve.

3. The press according to claim 1, further comprising:

means for pressurizing the cylinder rearward of the piston in the closed position of the valve for extrusion of the billet in the holder.

* * * * *